US011209783B2

(12) United States Patent
Bushnell et al.

(10) Patent No.: US 11,209,783 B2
(45) Date of Patent: Dec. 28, 2021

(54) WATCH WITH OPTICAL SENSOR FOR USER INPUT

(71) Applicant: Apple Inc., Cupertino, CA (US)

(72) Inventors: Tyler S. Bushnell, Mountain View, CA (US); Sameer Pandya, Sunnyvale, CA (US); Steven P. Cardinali, Campbell, CA (US)

(73) Assignee: Apple Inc., Cupertino, CA (US)

( * ) Notice: Subject to any disclaimer, the term of this patent is extended or adjusted under 35 U.S.C. 154(b) by 263 days.

(21) Appl. No.: 16/523,815

(22) Filed: Jul. 26, 2019

(65) Prior Publication Data

US 2020/0033815 A1 Jan. 30, 2020

Related U.S. Application Data

(60) Provisional application No. 62/712,169, filed on Jul. 30, 2018.

(51) Int. Cl.

| | |
|---|---|
| ***G04G 21/08*** | (2010.01) |
| ***G04G 11/00*** | (2006.01) |
| ***G04G 17/04*** | (2006.01) |
| ***G04G 21/06*** | (2010.01) |

(52) U.S. Cl.

CPC ..... *G04G 21/08* (2013.01); *G04G 11/00* (2013.01); *G04G 17/045* (2013.01); *G04G 21/06* (2013.01)

(58) Field of Classification Search

CPC ..... G04G 21/08; G04G 11/00; G04G 17/045; G04G 21/06; G04B 3/001; H01H 3/122; H01H 9/16; H01H 25/008; H01H 2215/006; H01H 2221/01; H01H 25/06; H01H 2209/006; H01H 2223/002

USPC ..... 368/69, 276, 185–187, 289, 308, 319; 200/4

See application file for complete search history.

(56) References Cited

U.S. PATENT DOCUMENTS

| | | | | |
|---|---|---|---|---|
| 9,709,956 | B1 * | 7/2017 | Ely | G06F 3/0362 |
| 2007/0152966 | A1 | 7/2007 | Krah et al. | |
| 2011/0090148 | A1 * | 4/2011 | Li | G06F 3/0354 345/158 |
| 2014/0078318 | A1 | 3/2014 | Alameh | |
| 2014/0139422 | A1 | 5/2014 | Mistry et al. | |

(Continued)

FOREIGN PATENT DOCUMENTS

| | | |
|---|---|---|
| WO | WO 2016/208835 | 12/2016 |

*Primary Examiner* — Edwin A. Leon

(74) *Attorney, Agent, or Firm* — Morgan, Lewis & Bockius LLP

(57) ABSTRACT

A watch can include a user input component that employs an optical sensor to receive input from a user. The input components provide an ability for a user to interact with the watch in a manner similar to how a user would interact with a crown that is rotatable and/or translatable. The user can provide motions and gestures near the input component that the input component can detect and interpret and user inputs to control an aspect of the watch. The motions and gestures provided by the user can be directly detected with optical systems of the input component, so that the number of moving parts are reduced and space within the watch is more efficiently utilized. While providing these benefits, the input component provides a user experience that simulates user interactions with a crown that is rotatable and/or translatable.

20 Claims, 5 Drawing Sheets

(56) References Cited

U.S. PATENT DOCUMENTS

| | | | | |
|---|---|---|---|---|
| 2016/0058375 | A1* | 3/2016 | Rothkopf | G04G 17/02 600/301 |
| 2017/0090599 | A1* | 3/2017 | Kuboyama | G04G 21/08 |

* cited by examiner

WATCH WITH OPTICAL SENSOR FOR USER INPUT

CROSS-REFERENCE TO RELATED APPLICATIONS

This application claims the benefit of U.S. Provisional Application No. 62/712,169, entitled "WATCH WITH OPTICAL SENSOR FOR USER INPUT," filed Jul. 30, 2018, the entirety of which is incorporated herein by reference.

TECHNICAL FIELD

The present description relates in general to user input components, and more particularly to, for example and without limitation, optical sensors of watches for user input.

BACKGROUND

Portable electronic devices, such as watches, have become increasingly popular, and the features and functionality provided by portable electronic devices continue to expand to meet the needs and expectations of many consumers. User interface features are often provided on electronic devices to allow a user to provide commands for execution by the devices. Many devices include input components, such as crowns, that receive and detect tactile input from a user during operation. Such input components may be prominently featured on the device for ready access by a user.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The present description relates in general to assemblies for user input components, and more particularly to, for example and without limitation, optical sensors of watches for user input. Electronic devices, such as watches, can include one or more user input components, such as crowns, dials, and/or buttons, at an external surface thereof for receiving input from a user. The input components can provide the user with the ability to interact with and provide instructions to the electronic device.

However, user input components, such as crowns, can occupy space on a watch that could otherwise be occupied by other components of the watch. Some user input components include moving parts, which are susceptible to wear. User input components can also be susceptible to damage resulting from impact during normal use or when the watch is inadvertently dropped.

Embodiments of the present disclosure can provide a watch with user input components that employ an optical sensor to receive input from a user. The input components provide an ability for a user to interact with the watch in a manner similar to how a user would interact with a crown that is rotatable and/or translatable. For example, the user can provide motions and gestures near the input component that the input component can detect and interpret and user inputs to control an aspect of the watch. The motions and gestures provided by the user can be directly detected with optical systems of the input component, so that the number of moving parts are reduced and space within the watch is more efficiently utilized. While providing these benefits, the input component provides a user experience that simulates user interactions with a crown that is rotatable and/or translatable.

These and other embodiments are discussed below with reference to FIGS. 1-12. However, those skilled in the art will readily appreciate that the detailed description given herein with respect to these Figures is for explanatory purposes only and should not be construed as limiting.

Figure 1:
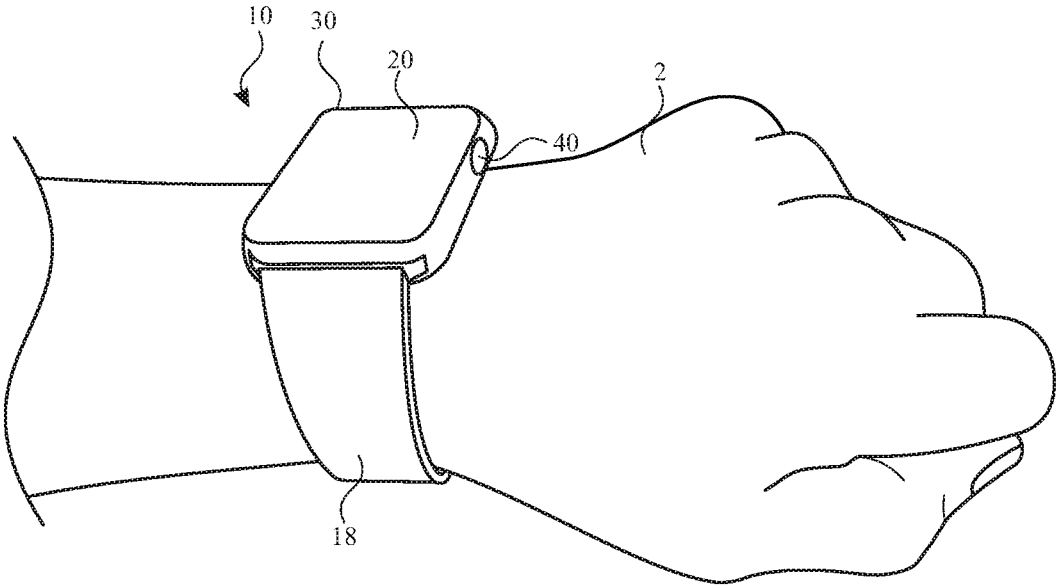
FIG. 1 illustrates a perspective view of a watch on a wrist of a user, according to some embodiments of the present disclosure.

Referring to FIG. 1, a wearable electronic device, such as a watch 10, is shown. The watch 10 is worn on a wrist of a user 2 with a watch band 18. The watch 10 can be portable and also attached to other body parts of the user or to other devices, structures, or objects. The watch band 18 can be flexible and encircle at least a portion of the wrist of a user 2. By securing the watch 10 to the person of the user, the watch band 18 provides security and convenience.

While FIG. 1 illustrates the device as the watch 10, it will be recognized that features described herein with respect to the watch 10 can be applied to a variety of other devices, such as other wearable devices, other electronic devices, portable computing devices, cell phones, smart phones, tablet computers, laptop computers, cameras, timekeeping devices, virtual reality devices, augmented reality devices, mixed reality devices, computerized glasses, and other wearable devices navigation devices, displays, sports devices, accessory devices, health-monitoring devices, medical devices, wristbands, bracelets, jewelry, and/or the like.

The watch 10 can include one or more I/O systems. For example, a display 20 can be configured to visually output information. The display 20 of the watch 10 can also be configured to receive touch input from a user. The housing 30 can support the display 20. The display 20 can include or be provided with a cover glass that defines an outermost surface of the display 20. The housing 30 can serve to surround a peripheral region as well as support the internal components of the watch 10 in their assembled position. For example, the housing 30 encloses and supports various internal components (including for example integrated circuit chips, processors, memory devices and other circuitry) to provide computing and functional operations for the watch 10.

Figure 2:
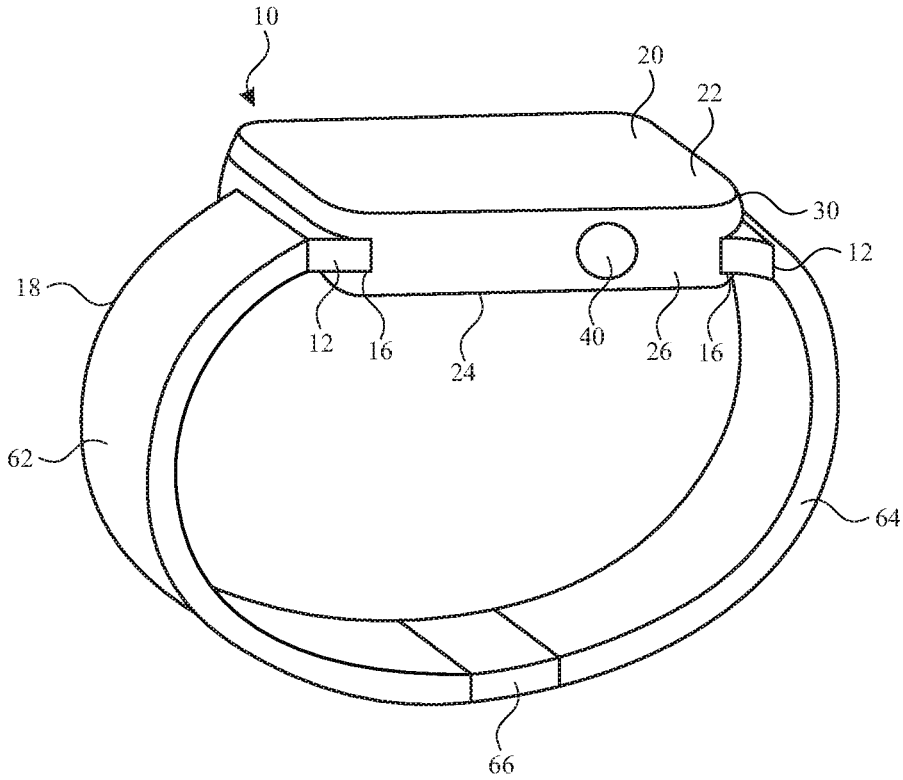
FIG. 2 illustrates a perspective view of a watch, in accordance with some embodiments of the present disclosure.

Referring to FIG. 2, the watch 10 can utilize a watch band 18 for attaching the watch 10 to a wrist. For example, as shown in FIG. 2, the watch band 18 can include a first band strap 62 attached to a first attachment unit 12 of the watch 10 and a second band strap 64 attached to a second attachment unit 12 of the watch 10. In some embodiments, free ends of the first band strap 62 and the second band strap 64 can be configured to be releasably attached or secured to one another using a clasp 66 or other attachment mechanism to form a loop. This loop can then be used to attach the watch 10 to a user's wrist.

Although a single attachment unit 12 is discussed herein, a plurality of attachment units 12 can be coupled to the housing 30. When multiple attachment units 12 are used, as shown in FIG. 2, the housing 30 can have a band retaining feature 16 (e.g., channel, latch, clip, recess, lock or other such coupling node) on a first side and a second side, opposite the first side, of the housing 30. While the band retaining feature 16 of FIG. 2 is shown as a channel, it will be understood that other retention mechanisms can be applied. The band retaining feature 16 on the first side of the housing 30 can receive one of the attachment units 12 and the band retaining feature 16 on the second side of the housing 30 can receive another attachment unit 12. The attachment units 12 can have a same or different size and/or shape, wherein the size and/or shape corresponds to a size and/or shape of the respective band retaining feature 16. As shown in FIG. 2, the housing 30 includes one or more band retaining features 16 that mechanically engage a corresponding attachment unit 12. The band retaining features 16 include an opening while the attachment unit 12 includes a lug that fits within the opening. The opening can be configured in a variety of different shapes and orientations.

The housing 30 can have multiple sides that are formed together to define a periphery of the housing 30. The housing 30 can have a front side 22 and a rear side 24 opposite the front side 22. The front side 22 faces away from a wrist of the user when the watch 10 is worn. The display 20 can be provided on the front side 22 of the housing 30 for displaying images to the user. The rear side 24 faces toward the wrist of the user when the watch 10 is worn. Other components, such as one or more sensors, can be provided on the rear side 24 of the housing 30 for monitoring biometric characteristics of the user.

The housing 30 can further include multiple lateral sides 26 that join together the front side 22 and the rear side 24 of the housing 30. For example, one or more of the lateral sides 26 (e.g., opposing lateral sides 26) can include a band retaining feature 16. At least one of the lateral sides 26 can include one or more input components 40. As used herein, an input component can be any device that is configured to receive and detect input from a user. The input component 40 can detect motion, position, orientation, speed, acceleration, contact, and/or proximity of the user (e.g., finger, hand, or limb of the user). As discussed further herein, the input component 40 can include an optical sensor for detecting user input.

While the input component 40 of FIG. 2 is represented as being round and positioned on a lateral side 26, it will be understood that the input component 40 can be of any size, shape, and/or arrangement. For example, the input component 40 can be square, rectangular, polygonal, round, curved, arcuate, circular, semi-circular, flat, or another shape. By further example, the input component 40 can be positioned on any surface of the housing 30, including the front side 22, the rear side 24, and/or a lateral side 26.

Operation of the input component 40 can have one or more of a variety of effects. The input component 40 can be used to accept input from the user, which may be used to control aspects of the watch 10. For example, in response to a user input received by an input component 40, the watch can perform one or more of a variety of actions, as discussed further herein.

Figure 3:
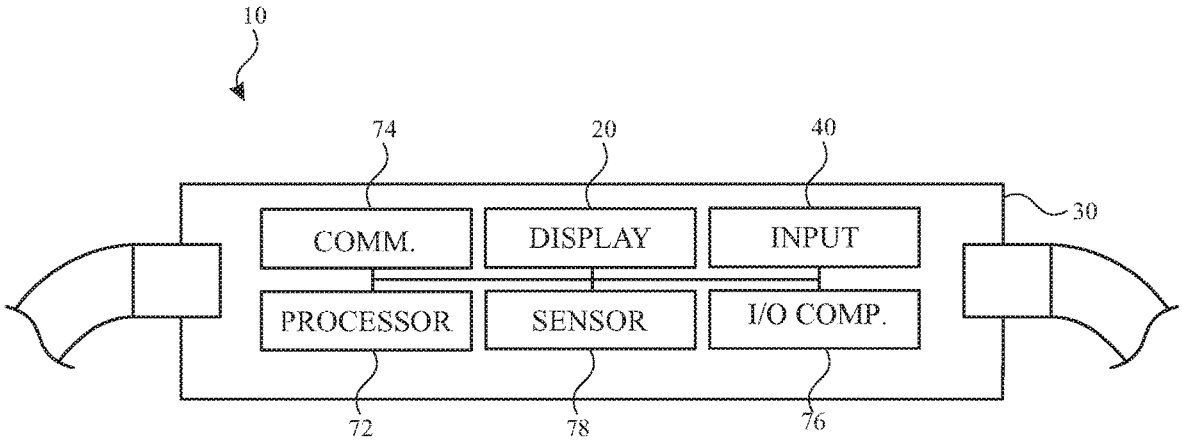
FIG. 3 illustrates a side view of a watch, in accordance with some embodiments of the present disclosure.

Referring to FIG. 3, the watch 10 can include components for performing various functions, including interacting with a user. For example, the display 20 can provide visual (e.g., image or video) output for the watch 10 and include an input surface for one or more touch input devices such as a touch sensor, force sensor, temperature sensor, and/or a fingerprint sensor. As discussed herein, the watch 10 can further include the input component 40 for receiving input from a user.

Additionally or alternatively, the watch 10 can include one or more other I/O components 76 for receiving input from and/or providing output to a user. I/O components 76 can include buttons, crowns, keys, dials, switches, trackpads, and the like. The user input can depress, rotate, move, tilt, flex, or deform the I/O component 76 in a manner that is detectable by the I/O component 76. The I/O component 76 can include or be connected to one or more sensors that detect the input. Sensors can include, for example, force sensors, pressure sensors, optical sensors, or proximity sensors. Where multiple I/O component 76 are provided, the input components can be of the same or different types (e.g., depressable and/or rotatable). By further example, an I/O component 76 can include a speaker, a microphone, and/or a haptic device. A haptic device can be implemented as any suitable device configured to provide force feedback, vibratory feedback, tactile sensations, and the like. The haptic device can be implemented as a linear actuator configured to provide a punctuated haptic feedback, such as a tap or a knock.

As further shown in FIG. 3, the watch 10 includes one or more processors 72 that include or are configured to access a memory having instructions stored thereon. The instructions or computer programs can be configured to perform one or more of the operations or functions described with respect to the watch 10. The processors 72 can be implemented as any electronic device capable of processing, receiving, or transmitting data or instructions. For example, the processors 72 can include one or more of: a microprocessor, a central processor (CPU), an application-specific integrated circuit (ASIC), a digital signal processor (DSP), or combinations of such devices. As described herein, the term "processor" is meant to encompass a single processor or processor, multiple processors, multiple processors, or other suitably configured computing element or elements. The memory can store electronic data that can be used by the watch 10. For example, a memory can store electrical data or content such as, for example, audio and video files, documents and applications, device settings and user preferences, timing and control signals or data for the various modules, data structures or databases, and so on. The memory can be configured as any type of memory. By way of example only, the memory can be implemented as random access memory, read-only memory, Flash memory, removable memory, or other types of storage elements, or combinations of such devices.

As further shown in FIG. 3, the watch 10 can include a communication component 74 that facilitates transmission of data and/or power to or from other electronic devices across standardized or proprietary protocols. For example, a communication component 74 can transmit electronic signals via a wireless and/or wired network connection. Examples of wireless and wired network connections include, but are not limited to, cellular, Wi-Fi, Bluetooth, infrared, RFID, and Ethernet.

As further shown in FIG. 3, the watch 10 can also include one or more sensors 78, such as biosensors. The one or more sensors 78 can be configured to sense substantially any type of characteristic such as, but not limited to, images, pressure, light, touch, force, temperature, position, motion, and so on. For example, the sensor(s) 78 can be a photodetector, a temperature sensor, a light or optical sensor, an atmospheric pressure sensor, a humidity sensor, a magnet, a gyroscope, an accelerometer, and so on. In other examples, the watch 10 can include one or more health sensors. In some examples, the health sensors can be disposed on a rear side of the housing 30 of the watch 10. The one or more sensors 78 can include optical and/or electronic biometric sensors that can be used to compute one or more biometric characteristics. A sensor 78 can include a light source and a photodetector to form a photoplethysmography (PPG) sensor. Light can be transmitted from the sensor 78, to the user, and back to the sensor 78. For example, the housing 30 can provide one or more windows (e.g., opening, transmission medium, and/or lens) to transmit light to and/or from the sensor 78. The optical (e.g., PPG) sensor or sensors can be used to compute various biometric characteristic including, without limitation, a heart rate, a respiration rate, blood oxygenation level, a blood volume estimate, blood pressure, or a combination thereof. One or more of the sensors 78 can also be configured to perform an electrical measurement using one or more electrodes. The electrical sensor(s) can be used to measure electrocardiographic (ECG) characteristics, galvanic skin resistance, and other electrical properties of the user's body. Additionally or alternatively, a sensor 78 can be configured to measure body temperature, exposure to UV radiation, and other health-related information.

The watch 10 can include other components to support those described herein. For example, the watch 10 can include a battery that is used to store and provide power to the other components of the watch 10. The battery can be a rechargeable power supply that is configured to provide power to the watch 10. The watch 10 can also be configured to recharge the battery using a wireless charging system.

Figure 4:
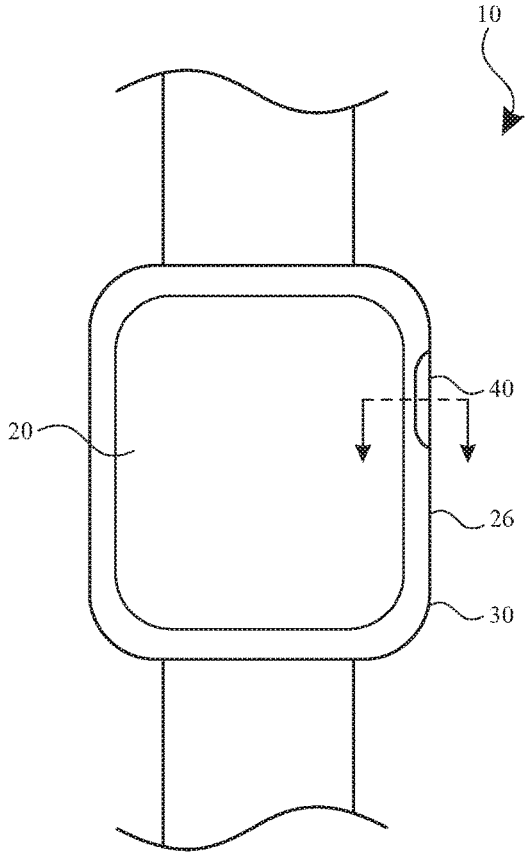
FIG. 4 illustrates a front view of a watch, in accordance with some embodiments of the present disclosure.

Referring to FIG. 4, the input component 40 can be provided along a side of the housing, such as the lateral side 26. Such a configuration allows the input component 40 to be readily accessible by a user without interfering with a user's view and usage of the display 20. While the input component 40 of FIG. 4 is shown with an outer periphery that is flush with an exterior surface of the housing 30, it will be understood that the input component 40 can protrude beyond the exterior surface of the housing 30, as discussed further herein. Additionally or alternatively, the input component 40 can be recessed within the exterior surface of the housing 30. Where the input component 40 is flush or recessed with respect to the housing 30, the input component can be protected from impact resulting from normal use and/or inadvertent drops. For example, the housing 30 can present an outermost periphery that protects the input component 40, even when forces are applied to a side that contains the input component 40.

Figure 5:
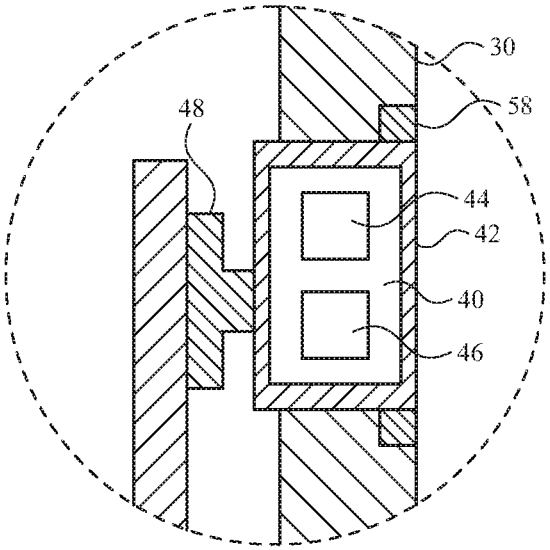
FIG. 5 illustrates a sectional view of a portion of the watch of FIG. 4, in accordance with some embodiments of the present disclosure.
Figure 6:
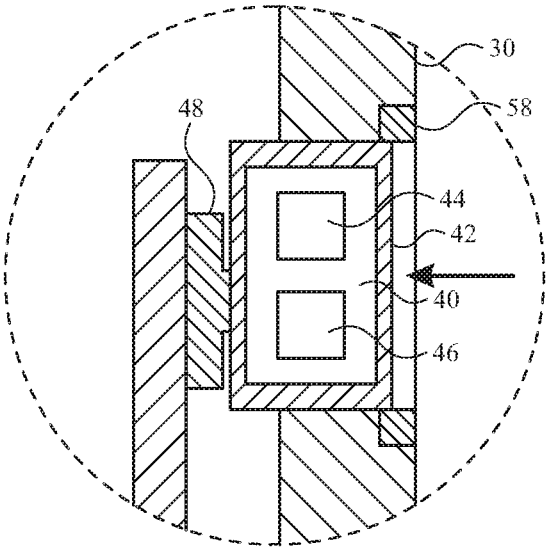
FIG. 6 illustrates a sectional view of a portion of the watch of FIG. 4, in accordance with some embodiments of the present disclosure.

Referring to FIGS. 5 and 6, the input component 40 can be used to optically detect user inputs. The input component 40 can include a light source 44, such as light emitting diodes (LEDs). Additionally or alternatively, laser diode can be used. The light source 44 can include a single emitter or multiple emitters. The light source 44 can emit a single frequency, multiple frequencies (e.g., RGB), and/or invisible frequencies (e.g., infrared, UV).

The input component 40 can further include an optical sensor 46, such as a photodiode or a photodiode array. Additionally or alternatively, the input component 40 can include one or more of various types of optical sensors that are arranged in various configurations for detecting user inputs described herein. For example, motion of a user can be detected by an image sensor, a light sensor such as a CMOS light sensor, CCD sensor, a photovoltaic cell, a photo resistive component, a laser scanner, and the like.

The input component 40 can provide one or more windows 42 (e.g., opening, transmission medium, and/or lens) to transmit light from the light source 44 and/or to the optical sensor 46. The window 42 can include a light transmitting material that provides a surface to which a user can apply tactile input. The window 42 can form at least part of an enclosure that contains the light source 44 and/or the optical sensor 46. The window 42 can provide optical effects for the transmitted light. For example, the window 42 can include a diffuser, and/or a lens. While the input component 40 of FIGS. 5 and 6 is represented as including a light source 44 and an optical sensor 46 within a single enclosure and having a single window 42, it will be understood that a light source 44 and an optical sensor 46 can be provided in separate enclosures and/or with separate windows 42 for transmitting light. It will also be understood that any one enclosure can contain any number of light sources 44 and optical sensors 46.

In use, the input component 40 can optically track motion of a user (e.g., finger). The light source 44 can emit light through the window 42 onto the finger. The light can be reflected off of the finger and through the window 42 to the optical sensor 46. The optical sensor 46 can capture a series of images across a period of time.

The watch can be configured to optimize operational efficiency of the light source 44 and/or the optical sensor 46. The watch can include a proximity sensor 58 that detects a presence of a user (e.g., finger, hand, or limb of the user) within a certain distance of the input component 40. For example, the proximity sensor 58 can detect when a finger is applied to the input component 40 or a vicinity thereof. The proximity sensor 58 can include a touch sensing device, a force sensing device, a temperature sensing device, a capacitive sensing device, a resistive sensing device, and/or an optical sensing device. The proximity sensor 58 can extend at least partially about a periphery of the input component 40. For example the proximity sensor 58 can include a ring that surrounds the input component 40.

The proximity sensor 58 can be in communication with the processor of the watch to indicate when the user is within a certain distance of the input component 40. The processor can control operation of the light source 44 and/or the optical sensor 46 accordingly. For example, when the presence of the user is not detected within a certain distance of the input component 40, the light source 44 and/or the optical sensor 46 can operate in a reduced power mode or not at all to conserve power. In the reduced power mode, the light source 44 can emit less light or no light. In the reduced power mode, the optical sensor 46 can acquire fewer images or no images. By further example, when the presence of the user is detected within a certain distance of the input component 40, the light source 44 and/or the optical sensor 46 can operate in a higher power mode. In the higher power mode, the light source 44 can emit more light. In the higher power mode, the optical sensor 46 can acquire a greater number of images, for example, with greater frequency (e.g., frame rate), or images with higher resolution.

The watch can include a switch for accepting translational input from the user. As shown in FIGS. 5 and 6, a force sensor assembly can include the input component 40 and a force sensor 48. The force sensor 48 can include a dome switch that is configured to provide a tactile feedback when actuated. The actuation of a dome switch can be perceived by the user as a click or release as the force sensor 48 is actuated. Once the force has been removed from the input component 40, the dome switch resiliently returns to its original position, providing a biasing force to return the input component 40 to its original position. Additionally or alternatively, the force sensor 48 may include a separate biasing element, such as a spring, that exerts a force (either directly or indirectly) against the input component 40. FIG. 5 depicts the force sensor 48 when there is no force applied (i.e., un-actuated). FIG. 6 depicts the force sensor 48 when there is a translational force applied to the input component 40 (i.e., actuated). As shown in FIGS. 5 and 6, the input component 40 is translatable relative to the housing 30, providing an ability for the user to translate the input component 40 and apply a translating force to the force sensor 48. Actuation of the force sensor 48 can provide a binary output (actuated/not actuated) and/or a non-binary output that corresponds to the amount of translation along the axis of motion.

Figure 7:
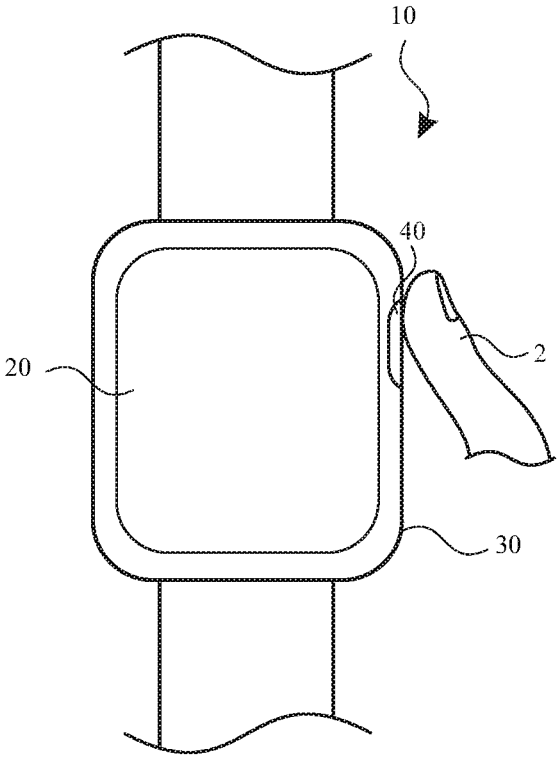
FIG. 7 illustrates a front view of the watch of FIG. 4, in accordance with some embodiments of the present disclosure.
Figure 8:
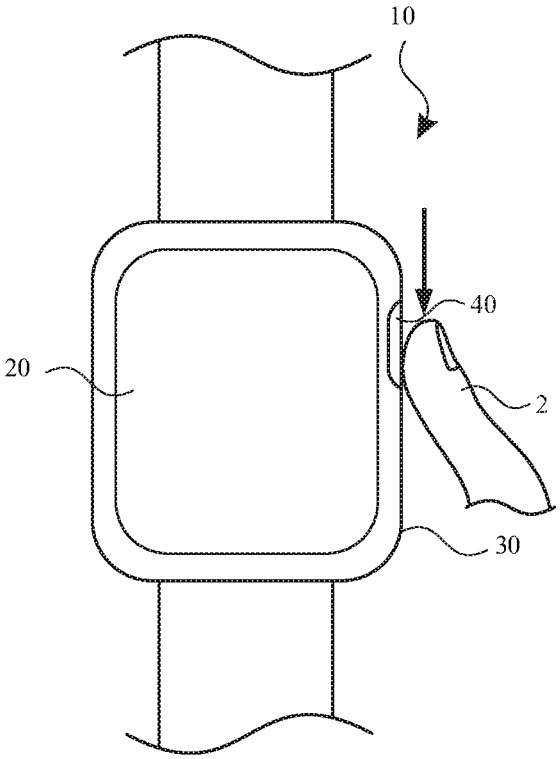
FIG. 8 illustrates a front view of the watch of FIG. 4, in accordance with some embodiments of the present disclosure.

Referring to FIGS. 7 and 8, the input component 40 can be used to detect a user input. More specifically, the example provided below with respect to FIGS. 7 and 8 may use its optical sensor to detect motion, position, orientation, speed, acceleration, contact, and/or proximity of the user (e.g., finger, hand, or limb of the user. Once the user input has been detected, this information may be used to output or change information and images that are presented on a display or user interface of the watch.

Integrating a rotary input device (e.g., crown) into the space constraints of a typical wearable electronic device may be particularly challenging. Specifically, some traditional rotary input configurations may be undesirably large or delicate for use in a portable electronic device. The optical sensor described below may provide certain advantages over some traditional rotary input configurations and may be particularly well suited for use with a watch.

As shown in FIGS. 7 and 8, a user 2 can move a portion of a finger, hand, or limb past the input component 40, which detects the motion. As discussed herein, the light source of the input component 40 can emit light through the window onto the finger, and the light can be reflected off of the finger and through the window to the optical sensor of the input component 40. The input component 40 can capture a series of images across a period of time. A feature of the finger can be detected and tracked to determine its position in each image. For example, the finger can include visible features such as ridges, grooves, textures, patterns, colors, and/or variations of one or more of these across an area of the finger. As the optical sensor 46 determines the location of any given feature across multiple images, the input component 40 can determine the motion, position, orientation, speed, acceleration, contact, and/or proximity of the finger with respect to the input component 40. Once this information is determined, it can be used to output or change information or images that are presented on the display 20 or another user interface of the watch 10.

The input component 40 can be configured to detect motion in one dimension, two dimensions, or three dimensions. For example, the input component 40 can detect motion of a finger along an axis that passes by the input component 40. While the motion may include other directions, the input component 40 can filter to exclude directions other than those along the axis. By further example, the input component 40 can detect motion of a finger within a two-dimensional plane, such as a plane of or parallel to an outer surface of the window. By further example, the input component 40 can detect motion of a finger within a three-dimensional space, including variations in distance from the input component 40.

Operation of the input component 40 can have one or more of a variety of effects. For example, in response to a user input received by an input component 40, the watch can perform one or more of a variety of actions. While such actions can include any preprogrammed or user-selected action, various examples are provided herein by way of illustration and not limitation.

The input component 40 can be operated by the user to scroll the display 20 or select from a range of values. The input component 40 can be rotated to move a cursor or other type of selection mechanism from a first displayed location to a second displayed location in order to select an icon or move the selection mechanism between various icons that are output on the display 20. In a time keeping application, the input component 40 can be used to adjust the position of watch hands or index digits displayed on the display 20 of the watch 10. The input component 40 can also be used to control the volume of a speaker, the brightness of the display screen, or control other hardware settings. Other actions can include one or more of launching a program, displaying particular information, changing an aspect of the display, communicating with an external device, initiating a call, sending a message, activating a microphone for receiving and recognizing voice input from the user, providing a sound, initiating a financial transaction, restarting the watch, turning off the watch, taking a screenshot, activating the screen, tracking activity of the user, taking a biometric reading, recording a location of the user, and/or modifying settings of the watch.

Where an action relates to a setting (volume of a speaker, brightness of the display screen, etc.) of the watch, the input component 40 can detect motion in a single axis and provide an output that corresponds to an effect on the setting. For example, detected motion of a finger in a first direction (e.g., up) can increase a quantitative setting (e.g., increase volume, brightness). By further example, detected motion of a finger in a second direction (e.g., down), opposite the first direction, can decrease a quantitative setting (e.g., decrease volume, brightness).

An action can be general across an operating system of a watch, such that the action can be performed at any time during operation of the watch. Additionally or alternatively, an action can be specific to an application that is actively operating on the watch, such that the action can only be performed when the application is active. An action can be specific to a particular combination of input components receiving user input simultaneously or in a particular sequence. Accordingly, a user input can include input provided to more than one input component. An action can be specific to other contextual factors, such as an attribute of a user input or an operational parameter of the watch.

Figure 9:
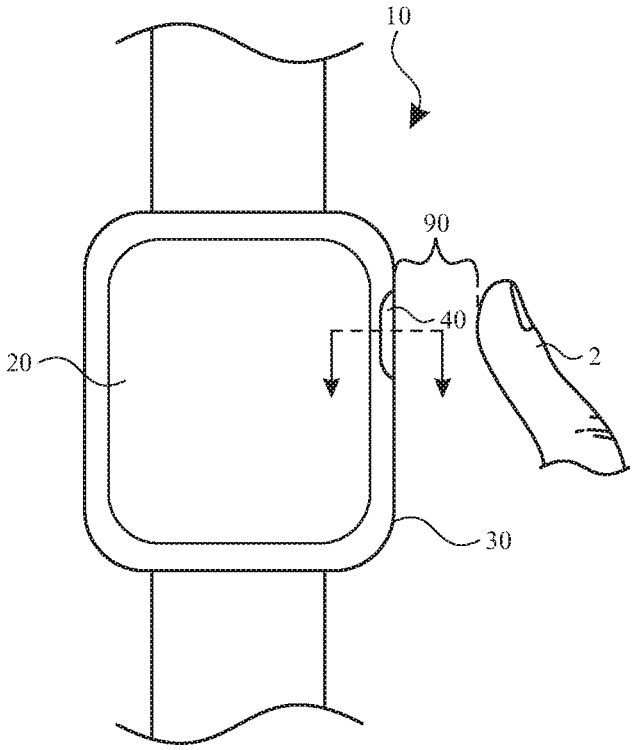
FIG. 9 illustrates a front view of the watch of FIG. 4, in accordance with some embodiments of the present disclosure.
Figure 10:
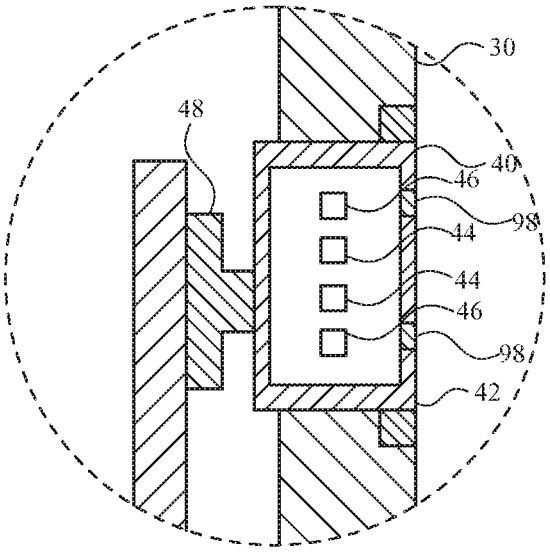
FIG. 10 illustrates a sectional view of a portion of the watch of FIG. 9, in accordance with some embodiments of the present disclosure.

Referring to FIGS. 9 and 10, the input component 40 can be configured to detect user input at one or more distances 90 away from the input component 40. The distance 90 can be zero (e.g., contacting the input component 40) or non-zero. The distance 90 can be determined based on the light source 44, the window 42, and/or the optical sensor 46.

For example, as shown in FIG. 10, the light source 44 can be configured to emit light sufficient to track user motion only to a certain distance. The window 42 and/or the optical sensor 46 can include one or more lenses 98 that produces a finite focal length, so that only objects at a certain distance 90 are in focus. Each of the lenses can have a different focal length. Accordingly, the input component 40 can be configured to detect only objects at a given distances 90 away from the input component 40.

As further shown in FIG. 10, the input component 40 can include multiple light sources 44, windows 42, lenses 98, and/or optical sensors 46, such that each of the optical sensors 46 is configured to detect motions of a finger at different distances 90 away from the corresponding optical sensor 46. For example, a first optical sensor 46 can be configured (e.g., by parameters of a first light source 44, a first window 42 or lens 98, and/or a first optical sensor 46) to detect user input at a first distance away from the input component 40, and a second optical sensor 46 can be configured (e.g., by parameters of a second light source 44, a second window 42 or lens 98, and/or a second optical sensor 46) to detect user input at a second distance, different than the first distance, away from the input component 40. At least one of the distances can be zero (e.g., contacting the input component 40). Accordingly, different outputs and/or actions can be assigned to user inputs detected at different distances away from the input component 40.

Figure 11:
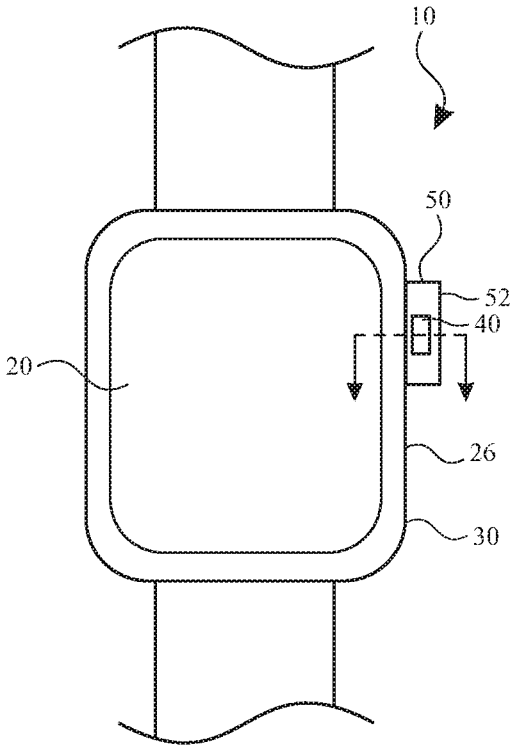
FIG. 11 illustrates a side view of a watch, in accordance with some embodiments of the present disclosure.

Referring to FIG. 11, an input component 40 can be provided on a protrusion 50 that extends away from other portions of a housing 30 of a watch 10. The protrusion 50 can extend from a side of the housing 30, such as the lateral side 26. The position of the input component 40 on the protrusion 50 allows the input component 40 to be readily accessible by a user without interfering with a user's view and usage of the display 20. Furthermore, the shape, size, and other characteristics of the protrusion 50 can simulate characteristics of a rotary crown on a watch, such that the user can interact with the protrusion 50 in a manner similar to how a user would interact with a rotary crown.

As shown in FIG. 11, the protrusion 50 can extend away from and beyond an exterior surface of the housing 30, for example, at the lateral side 26. While the protrusion 50 of FIG. 11 is represented as being cylindrical and positioned on a lateral side 26, it will be understood that the protrusion 50 can be of any size, shape (e.g., cross-sectional shape), and/or arrangement. For example, the protrusion 50 can be square, rectangular, polygonal, round, curved, arcuate, circular, semi-circular, flat, or another shape in cross-section. By further example, the protrusion 50 can be positioned on any surface of the housing 30, including the front side 22, the rear side 24, and/or a lateral side 26.

Figure 12:
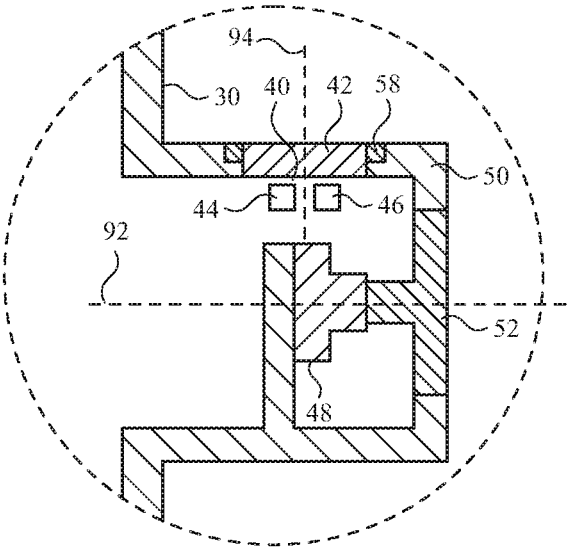
FIG. 12 illustrates a sectional view of a portion of the watch of FIG. 11, in accordance with some embodiments of the present disclosure.

As shown in FIG. 12, the protrusion 50 can extend along a first axis 92 that intersects an interior of the housing 30. The input component 40 positioned on the protrusion 50 can face in a direction along a second axis 94 that is different than the first axis 92. For example, while the protrusion 50 extends along the first axis 92 away from an interior of the housing 30, the input component 40 can face in a direction (e.g., along the second axis 94) that is orthogonal or transverse to the first axis 92. The extension of the protrusion along the first axis 92 provides a surface for supporting the input component 40. For example, the input component 40 can face in a direction that is parallel to a direction in which the display is facing on the front side of the housing 30. Such a configuration allows the input component 40 to be accessible on a front side of the protrusion 50 so that both the display and the input component 40 can face the user when the user is observing the watch.

As shown in FIG. 12, the protrusion 50 can extend from the housing 30. For example, the protrusion 50 can be unitary with the housing 30, integrally formed with the housing, and/or part of a monolithic structure that includes the housing 30. Alternatively, the protrusion 50 can be separate from the housing and joined (e.g., connected, coupled, attached, fixed, etc.) thereto. Some or all of the elements of the input component 40 can be housed within the protrusion 50, so that other space within an interior of the housing 30 is available for other components of the watch. Furthermore, the protrusion 50 can have sufficient rigidity and strength to protect the components contained therein during normal use and inadvertent drops of the watch. Where the outermost periphery and/or edges of the protrusion 50 are fixed with respect to the housing 30, the protrusion 50 can be resilient against impact, despite presenting an exposed and protruding profile.

Figure 13:
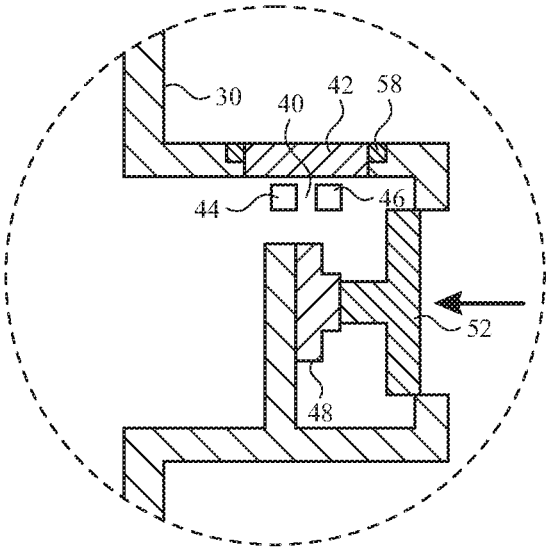
FIG. 13 illustrates a sectional view of a portion of the watch of FIG. 11, in accordance with some embodiments of the present disclosure.

Referring to FIGS. 12 and 13, the input component 40 can be used to optically detect user inputs. The input component can include elements that are similar to or identical to the elements described above with respect to FIGS. 5 and 6. For example, the input component 40 can include a light source 44, such as light emitting diodes (LEDs), within the protrusion 50. The input component 40 can further include an optical sensor 46, such as a photodiode or a photodiode array, within the protrusion 50. The input component 40 can provide one or more windows 42 (e.g., opening, transmission medium, and/or lens) on a side (e.g., front side) of the protrusion 50 to transmit light from the light source 44 and/or to the optical sensor 46. In use, the input component 40 can optically track motion of a user (e.g., finger). The light source 44 can emit light through the window 42 onto a finger. The light can be reflected off of the finger and through the window 42 to the optical sensor 46. The optical sensor 46 can capture a series of images across a period of time. The watch can also include a proximity sensor 58 on the protrusion 50 for detecting a presence of a user (e.g., finger, hand, or limb of the user) within a certain distance of the input component 40.

The watch can include a button 52 on the protrusion 50 and a force sensor 48 for accepting translational input from the user. As shown in FIGS. 12 and 13, a force sensor assembly can include the button 52 at an end of the protrusion 50 and a force sensor 48. The button can be positioned along the first axis 92, so that it forms a surface at an end of the protrusion 50. The force sensor 48 can include a dome switch that is configured to provide a tactile feedback when actuated. The actuation of a dome switch can be perceived by the user as a click or release as the force sensor 48 is actuated. Once the force has been removed from the button 52, the dome switch resiliently returns to its original position, providing a biasing force to return the button 52 to its original position. Additionally or alternatively, the force sensor 48 may include a separate biasing element, such as a spring, that exerts a force (either directly or indirectly) against the button 52. FIG. 12 depicts the force sensor 48 when there is no force applied (i.e., un-actuated). FIG. 13 depicts the force sensor 48 when there is a translational force applied to the button 52 (i.e., actuated). As shown in FIGS. 12 and 13, the button 52 is translatable relative to the housing 30 and/or the protrusion 50, providing an ability for the user to translate the button 52 and apply a translating force to the force sensor 48. Actuation of the force sensor 48 can provide a binary output (actuated/not actuated) and/or a non-binary output that corresponds to the amount of translation along the axis of motion. Such a configuration provides an ability for a user to interact with the button 52 in a manner similar to how a user would interact with a crown that is translatable.

Accordingly, embodiments of the present disclosure provide a watch with user input components that employ an optical sensor to receive input from a user. The input components provide an ability for a user to interact with the watch in a manner similar to how a user would interact with a crown that is rotatable and/or translatable. The user can provide motions and gestures near the input component that the input component can detect and interpret and user inputs to control an aspect of the watch. The motions and gestures provided by the user can be directly detected with optical systems of the input component, so that the number of moving parts are reduced and space within the watch is more efficiently utilized. While providing these benefits, the input component provides a user experience that simulates user interactions with a crown that is rotatable and/or translatable.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A watch comprising:

a housing defining a first side, a second side opposite the first side, and a third side joining the first side and the second side;

a display on the first side of the housing;

a touch sensor for receiving a touch input at the display; and an input component comprising:

a light source within the housing;

an optical sensor within the housing; and a window on the third side of the housing and configured to transmit light from the light source and to the optical sensor;

wherein the watch is configured to detect a user input with the input component, the user input comprising sliding by the user from a first position against the window to a second position against the window, and execute an action corresponding to the user input.

2. The watch of claim 1, further comprising:

a microphone;

a speaker;

a communication component for communicating wirelessly with another device; and band retaining features on opposing sides of the housing for releasably connecting the housing to a watch band.

3. The watch of claim 1, further comprising a sensor on the second side of the housing and configured to detect a characteristic of a user.

4. The watch of claim 3, wherein the sensor is a photoplethysmography sensor comprising a light emitter and a photodetector, wherein the second side includes a first window for transmitting light from the light emitter and a second window for transmitting light to the photodetector.

5. The watch of claim 1, wherein the window is movable against a force sensor within the housing.

6. The watch of claim 1, further comprising a proximity sensor configured to detect a presence of a finger within a distance of the window.

7. The watch of claim 6, wherein the proximity sensor comprises a capacitive sensor extending at least partially about the window.

8. The watch of claim 1, wherein the optical sensor is one of multiple optical sensors and the window comprises multiple lenses having different focal lengths so that each of the optical sensors is configured to detect motions of a finger at different distances away from the corresponding optical sensor.

9. A watch comprising:

a housing;

a display configured to display an image;

a touch sensor configured to receive touch input at the display;

an optical sensor spaced apart from the display and configured to detect a motion of a finger moving past the optical sensor; and a processor configured to execute an action comprising changing an output of the display, the action being based on an output of the optical sensor.

10. The watch of claim 9, wherein the action is to change a setting of the watch.

11. The watch of claim 9, wherein the action is to move the image on the display in a direction that is a direction of the motion of the finger moving past the optical sensor.

12. The watch of claim 9, wherein the output of the optical sensor indicates a component of the motion of the finger that is along an axis.

13. The watch of claim 9, wherein the optical sensor is one of multiple optical sensors within the housing, wherein each of the multiple optical sensors is configured to detect motions of the finger at different distances away from the corresponding optical sensor.

14. The watch of claim 9, further comprising a proximity sensor configured to detect a presence of a finger within a distance of the optical sensor, wherein the processor is configured to alter an operation of the optical sensor when the finger is detected within the distance of the optical sensor.

15. A watch comprising:

a housing defining a surface on a side thereof and a protrusion extending from the surface along a first axis;

a display supported by the housing;

a touch sensor for receiving a touch input at the display; and an input component comprising:

a light source within the protrusion;

an optical sensor within the protrusion; and a window configured to transmit light from the light source and to the optical sensor along a second axis that is orthogonal to the first axis;

wherein the watch is configured to detect a user input with the input component and execute an action corresponding to the user input.

16. The watch of claim 15, wherein the window faces a direction along the second axis, and the display faces a direction parallel to the second axis.

17. The watch of claim 15, further comprising a proximity sensor configured to detect a presence of a finger within a distance of the window.

18. The watch of claim 17, wherein the proximity sensor comprises a capacitive sensor extending at least partially about the window.

19. The watch of claim 15, further comprising a button configured to receive touch input at an end of the protrusion.

20. The watch of claim 15, wherein at least a portion of the protrusion is cylindrical.

* * * * *